US009476317B2

(12) United States Patent
Chouhan

(10) Patent No.: US 9,476,317 B2
(45) Date of Patent: Oct. 25, 2016

(54) FORWARD STEP HONEYCOMB SEAL FOR TURBINE SHROUD

(71) Applicant: General Electric Company, Schenectady, NY (US)

(72) Inventor: Rohit Chouhan, Bangalore Karnataka (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/748,322

(22) Filed: Jun. 24, 2015

(65) Prior Publication Data

US 2015/0292347 A1 Oct. 15, 2015

Related U.S. Application Data

(63) Continuation of application No. 13/342,278, filed on Jan. 3, 2012, now Pat. No. 9,080,459.

(51) Int. Cl.
*F01D 11/12* (2006.01)
*F01D 5/22* (2006.01)

(52) U.S. Cl.
CPC ..... *F01D 11/127* (2013.01); *F01D 5/225* (2013.01); *F05D 2220/32* (2013.01); *F05D 2230/80* (2013.01); *F05D 2240/11* (2013.01); *F05D 2250/283* (2013.01); *Y10T 29/49238* (2015.01)

(58) Field of Classification Search
CPC ..... F01D 11/00; F01D 11/08; F01D 11/12; F01D 11/127; F01D 5/225; B23P 6/005; B23P 6/00; B23P 6/002; F05D 2230/80
See application file for complete search history.

(56) References Cited

U.S. PATENT DOCUMENTS 2,910,269 A * 10/1959 Haworth ..... F01D 9/042 415/117
3,867,060 A 2/1975 Huber
3,876,330 A * 4/1975 Pearson ..... F01D 5/18 415/115
4,925,365 A * 5/1990 Crozet ..... F01D 9/04 277/415
5,064,343 A 11/1991 Mills
5,192,185 A * 3/1993 Leonard ..... F01D 11/08 415/170.1
5,201,846 A 4/1993 Sweeney
5,290,144 A 3/1994 Kreitmeier
7,255,531 B2 8/2007 Ingistov
8,011,883 B2 * 9/2011 Schwarz ..... F01D 11/20 415/127
2005/0002779 A1 1/2005 Tanaka
2005/0002780 A1 * 1/2005 Tanaka ..... F01D 5/225 415/173.1
2005/0058539 A1 3/2005 Diakunchak (Continued)

*Primary Examiner* — Eric Keasel
*Assistant Examiner* — Danielle M Christensen
(74) *Attorney, Agent, or Firm* — Sutherland Asbill & Brennan LLP

(57) ABSTRACT

The present application provides a stage of a gas turbine engine. The stage may include a bucket extending radially about a longitudinal axis of the gas turbine engine, a shroud facing the bucket, the shroud including a fore end portion including a radially inner surface spaced a first distance from the longitudinal axis, and a forward step honeycomb seal positioned on the shroud downstream of the fore end portion and facing the bucket. The forward step honeycomb seal may include a first linear portion including a radially inner surface spaced a second distance from the longitudinal axis, and a forward step portion positioned adjacent to and downstream of the first linear portion, the forward step portion including a radially inner surface spaced a third distance from the longitudinal axis, wherein the second distance is greater than the third distance, and wherein the third distance is greater than the first distance.

19 Claims, 4 Drawing Sheets

(56) References Cited

U.S. PATENT DOCUMENTS

2006/0133928 A1* 6/2006 Bracken ..... F01D 5/225
415/173.4
2007/0231132 A1 10/2007 Durand et al.
2009/0110536 A1 4/2009 Strock et al.
2011/0085893 A1 4/2011 Jain et al.
2011/0285090 A1 11/2011 Zheng

* cited by examiner

FORWARD STEP HONEYCOMB SEAL FOR TURBINE SHROUD

CROSS-REFERENCE TO RELATED APPLICATIONS

The present application is a continuation of copending U.S. patent application Ser. No. 13/342,278, filed on Jan. 3, 2012, which is hereby incorporated by reference in its entirety herein.

TECHNICAL FIELD

The present application and the resultant patent relate generally to gas turbine engines and more particularly relate to a forward step honeycomb seal for a turbine shroud with reduced leakage and reduced overall repair costs.

BACKGROUND OF THE INVENTION

Generally described, a gas turbine engine includes a combustor to produce a flow of hot combustion gases. The hot combustion gases are directed towards a turbine. The hot combustion gases impart a rotational force on the turbine blades therein so as to create mechanical energy. The turbine blades include end portions that rotate in close proximity to a turbine casing and the like. The closer the tip portions of the turbine blades may be to the turbine casing, the lower the energy losses therein. Specifically, when clearances between the bucket tip rails and the turbine casing are relatively high, the high energy combustion gases may escape without producing useful work. Reducing the clearances therein ensures that a larger portion of the thermal energy of the combustion gases is converted to mechanical energy so as to provide increased output and overall efficiency.

There is thus a desire for an improved seal for use in a gas turbine engine. Preferably, such an improved seal may provide increase efficiency and reduced leakage therethrough with fewer repairs and lower repair costs while also providing overall increased efficiency.

SUMMARY OF THE INVENTION

The present application and the resultant patent thus provide a stage of a gas turbine engine. The stage may include a bucket, a shroud facing the bucket, and a forward step honeycomb seal on the shroud. The forward step honeycomb seal may include a forward step portion and one or more linear portions.

The present application and the resultant patent further provide a method of retrofitting a turbine stage. The method may include the steps of removing a shroud with a number of projections thereon from the turbine stage, positioning a forward step honeycomb seal on a replacement shroud, positioning the replacement shroud in the turbine stage, and blocking an air gap between the shroud and a bucket with the forward step honeycomb seal.

The present application and the resultant patent further provide a stage of a gas turbine engine. The stage may include a bucket, a shroud facing the bucket, and a forward step honeycomb seal on the shroud. The forward step honeycomb seal may include a forward step portion, a first linear portion, and a second linear portion with the forward step portion including an offset position.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
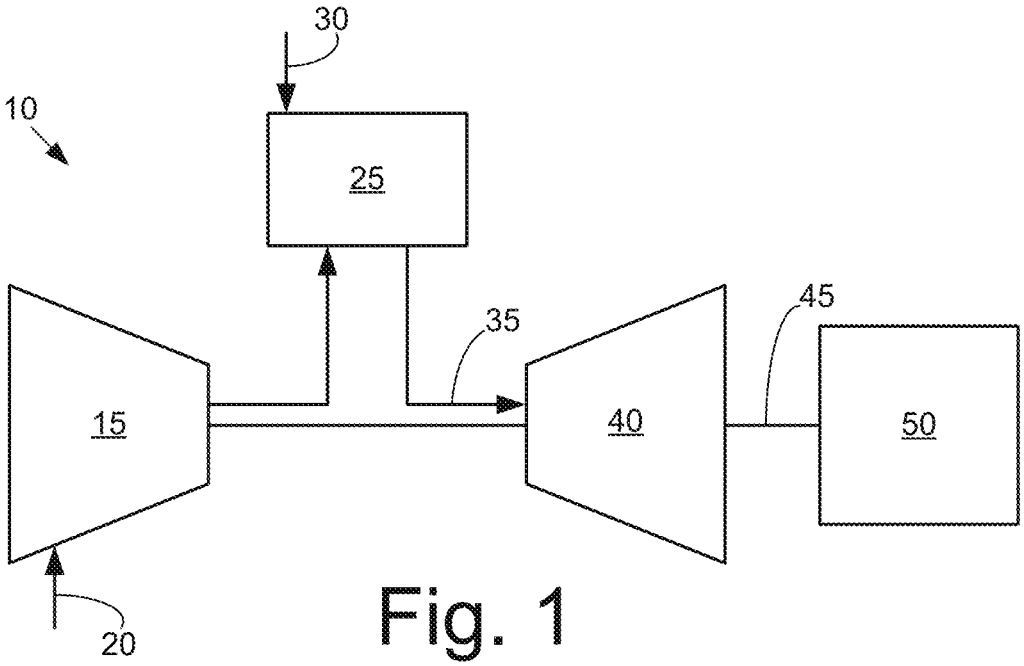
FIG. 1 is a schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
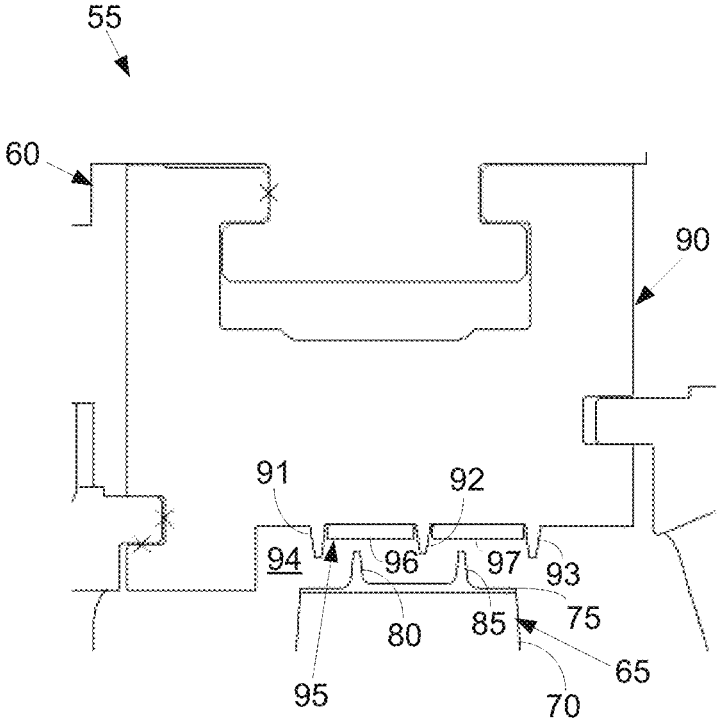
FIG. 2 is a side view of portions of a turbine stage with a known honeycomb seal therein.

FIG. 2 shows a portion of a turbine stage 55. The turbine stage 55 may be part of the turbine 40 described above and the like. In this example, the turbine stage 55 may be a second stage 60 of the turbine 40. Other stages 55 may be used herein. The turbine stage 55 may include a number of buckets 65. Each bucket 65 may include an airfoil 70. The airfoil 70 ends at a tip shroud 75. A pair of tip rails or projections may extend from the tip portion 75. In this example, a first projection 80 and a second projection 85 may be used. Any number of projections may be used herein.

The bucket 65 may be largely of conventional design. Other components and other configurations may be used herein.

The bucket 65 may be enclosed within a shroud 90. The shroud 90 may be in the form of a number of segments. Each of the segments of the shroud 90 also may include a number of projections extending toward the bucket 65. In this example, three projections or labyrinth teeth are shown, a first projection 91, a second projection 92, and a third projection 93. Any number of projections 91, 92, 93 may be used. The projections 91, 92, 93 of the shroud 90 and the projections 80, 85 of the bucket 65 serve to seal the leakage of hot combustion gases through a passage or a gap 94 between the bucket 65 and the shroud 90. Other components and other configurations may be used herein.

A honeycomb seal 95 also may be positioned on the shroud 90. In this example, the honeycomb seal 95 may include a first honeycomb seal member 96 and a second honeycomb seal member 97. Any number of honeycomb seal members 95 may be used herein. The first honeycomb seal member 96 may be positioned between the first projection 91 and the second projection 92 while the second honeycomb seal member 97 may be positioned between the second projection 92 and the third projection 93. The honeycomb seal members 96, 97 may have a generally linear, uniform shape. The honeycomb seal members 96, 97 may be formed from a deformable material. The honeycomb seal members 96, 97 face the projections 80, 85 of the bucket 65 so as to reduce the gap 94 over the projections 80, 85 and thus reduce the leakage of the hot combustion gases over the bucket tip shroud 75. Other components and other configurations may be used herein.

The honeycomb seal 95 of the shroud 90 thus uses the projections 91, 92, 93 and the honeycomb seal members 96, 97 to seal the leakage over the bucket tip 75. After an amount of time and extended operation, however, the projections 91, 92, 93 tend to oxidize and may fracture or otherwise begin to fail. As such, a leakage flow therethrough may increase such that the overall performance of the honeycomb seal 95 and the overall stage 55 may decrease.

Figure 3:
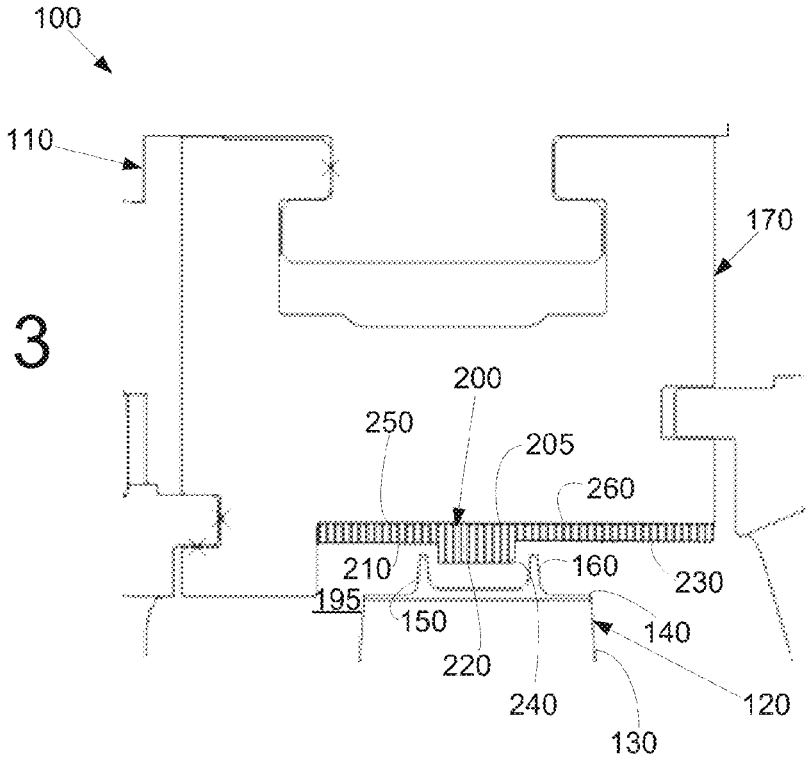
FIG. 3 is a side view of portions of an example of a turbine stage with a forward step honeycomb seal as may be described herein.

FIG. 3 shows a portion of a turbine stage 100 as may be described herein. As above, the turbine stage 100 may be used with the turbine 40 of the gas turbine engine 10 or otherwise. The turbine stage 100 may be a second stage 110. Other stages 100 may be used herein. The turbine stage 110 may include a number of buckets 120 therein. Each of the buckets 120 may include an airfoil 130. The airfoil 130 may have a tip portion 140 at one end thereof. The tip portion 140 may have a pair of labyrinth teeth or projections extending therefrom. In this example, a first projection 150 and a second projection 160 may be used. Any number of projections may be used herein. The bucket 120 may be largely of conventional design. Other components and other configurations may be used herein.

A shroud 170 may enclose the bucket 120. The shroud 170 may be in the form of a number of segments. The shroud 170 also may include a forward step honeycomb seal 200. The forward step honeycomb seal 200 may have a first linear portion 210, a forward step portion 220, and a second linear portion 230. The forward step portion 220 may have an offset position 240 such that a first length 250 of the first linear portion 210 may be less than a second length 260 of the second linear portion 230. Likewise, the forward step 220 may be positioned closer to the first projection 150 as compared to the second projection 160 of the bucket 120. (In other words, the forward step honeycomb seal 200 has the forward step portion 220 positioned about a forward end thereof and steps down into the air gap 195.) The forward step portion 220 may be placed anywhere before the second projection 160. The forward step honeycomb seal 200 may be attached to the shroud 170 via conventional means.

The first linear portion 210, the forward step portion 220, and the second linear portion 230 may form a unitary element or the portions may be segmented. The forward step portion 220 may extend downward from the shroud 170 towards the tip portion 140 of the bucket 120 and into the air gap 195. The relative size, shape, and configurations of the portions 210, 220, 230 may vary. The forward step honeycomb seal 200 may be made out of a deformable material 205. Other components and other configurations may be used herein.

In use, the flow of combustion gases 35 extends between the tip portion 140 of the bucket 120 and the forward step honeycomb seal 200 of the shroud 170 into the air gap 195. The size, shape, configuration of the forward step honeycomb seal 200 and the projections 150, 160 of the tip portion 140 of the bucket 120 thus improves overall system and stage efficiency by sealing effectively the air gap 195. Moreover, by the elimination of the projections 91, 92, 93, of the shroud 90 described above, significant saving in terms of repair time and repair costs may be provided. Specifically, the use of the forward step honeycomb seal 200 eliminates the projections 91, 92, 93 and the associated repair time and costs.

Although the turbine stage 100 has been described herein in terms of the second stage 110, the forward step honeycomb seal 200 may be applicable to other stages and other locations as well. The forward step honeycomb seal 200 may be original equipment or part of a repair or a retrofit. Specifically, the shroud 90 with the projections 91, 92, 93 may be removed and replaced with the shroud 170 with the forward step honeycomb seal 200 as described herein.

Figure 4:
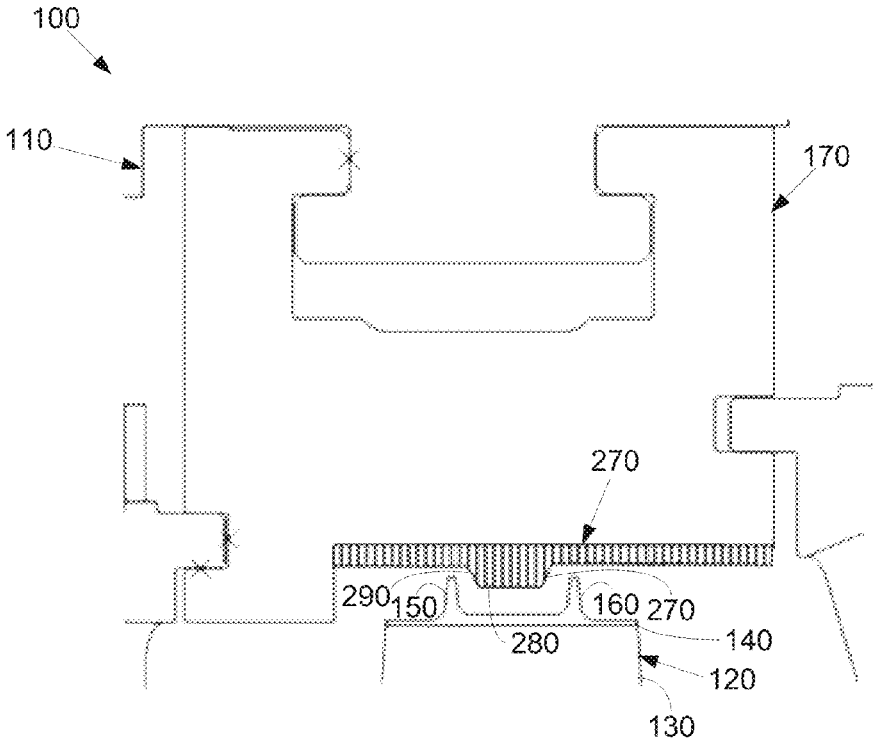
FIG. 4 is a side view of portions of a turbine stage with an example of an alternative embodiment of a forward step honeycomb seal as may be described herein.

FIG. 4 shows a further example of an embodiment of a forward step honeycomb seal 270. The forward step honeycomb seal 270 may be similar to that described above, but in this example, a forward step portion 280 may have a pair of angled sides 290. The angled sides 290 may be angled away from the projections 150, 160. The angles sides 290 may have any angle or shape. Other components and other configurations may be used herein.

Figure 5:
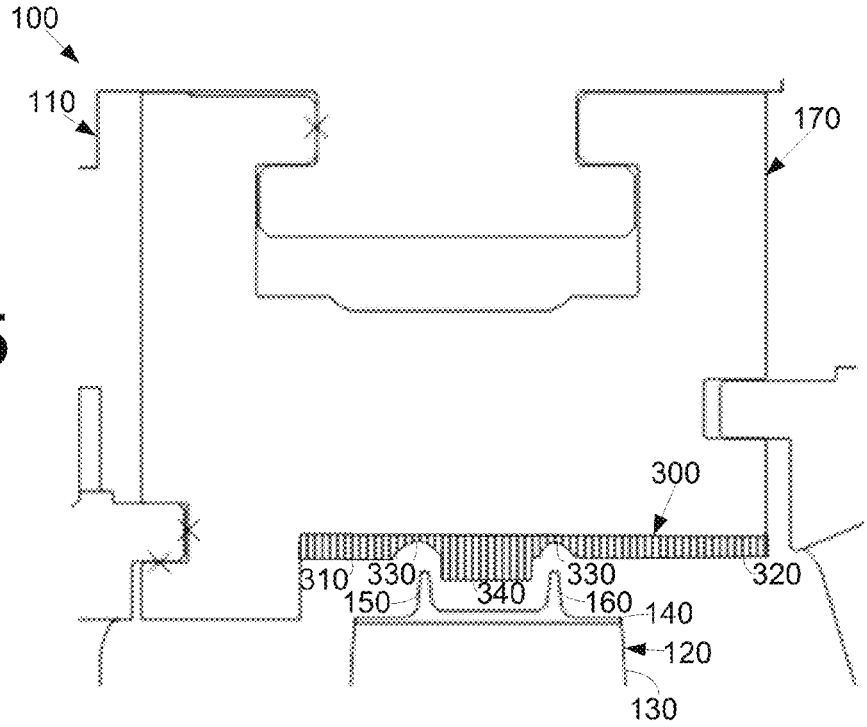
FIG. 5 is a side view of portions of a turbine stage with a further example of an alternative embodiment of a forward step honeycomb seal as may be described herein.

FIG. 5 shows a further example of an embodiment of a forward step honeycomb seal 300. In this example, a first linear portion 310 and a second linear portion 320 both have a groove 330 positioned on both sides of a forward step portion 340. The shape and size of the grooves 330 may vary. Other components and other configurations may be used herein.

Figure 6:
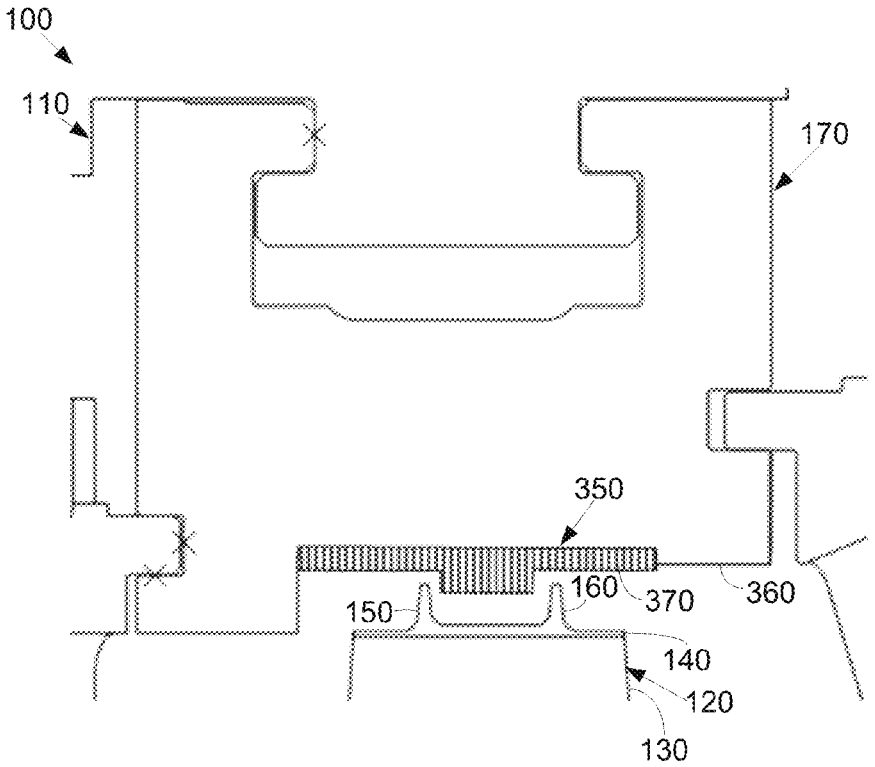
FIG. 6 is a side view of portions of a turbine stage with a further example of an alternative embodiment of a forward step honeycomb seal as may be described herein.

FIG. 6 shows a further example of an embodiment of a forward step honeycomb seal 350. The forward step honeycomb seal 350 may be similar to that described above, but an aft end 360 of the shroud 170 may extend inwardly such that a second linear portion 370 may be truncated. The aft end 360 and the second linear portion 370 may be aligned with one another or the second linear portion 370 may protrude somewhat therefrom. Other components or other configurations may be used herein.

Figure 7:
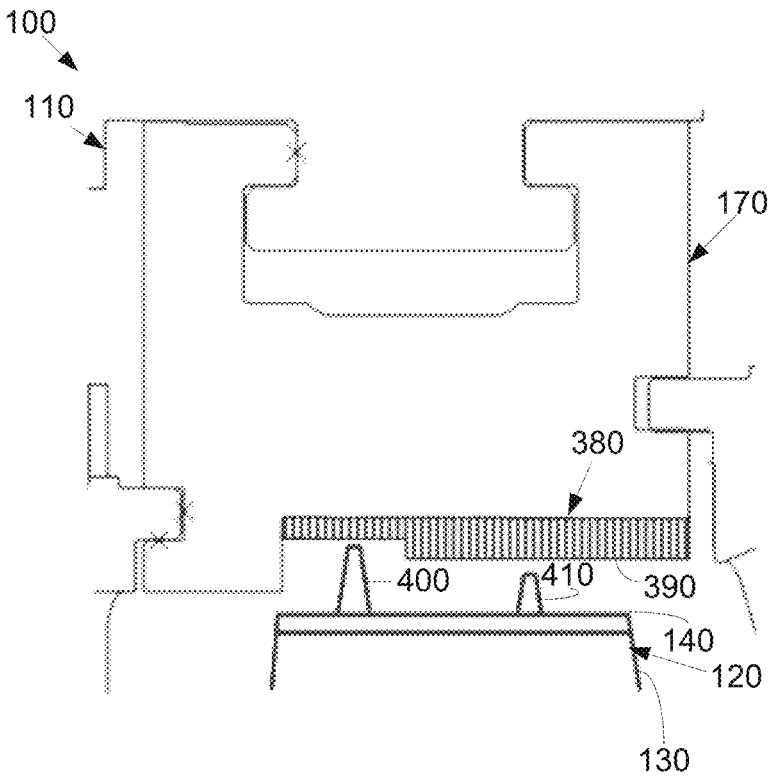
FIG. 7 is a side view of portions of a turbine stage with a further example of an alternative embodiment of a forward step honeycomb seal as may be described herein.

FIG. 7 shows a further example of an embodiment of a forward step honeycomb seal 380 as may be described herein. The forward step honeycomb seal 380 may be similar to that described above, but a forward step portion 390 may extend along the aft length of the shroud 170. In this example, a first projection 400 may be taller than a second projection 410 that extends underneath the extended forward step portion 390. The size and shape of the projections 400, 410 may vary. Other components and other configurations may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A stage of a gas turbine engine, comprising:

a bucket extending radially about a longitudinal axis of the gas turbine engine, the bucket comprising an airfoil and a tip portion extending from the airfoil, the tip portion comprising an upstream projection and a downstream projection extending away from the airfoil;

a shroud facing the bucket and having a cylindrical shape, the shroud comprising a fore end portion comprising a radially inner surface spaced a first distance from the longitudinal axis of the gas turbine engine; and a forward step honeycomb seal positioned on the shroud downstream of the fore end portion and facing the bucket, the forward step honeycomb seal comprising:

a first linear portion comprising a radially inner surface spaced a second distance from the longitudinal axis of the gas turbine engine; and a forward step portion positioned adjacent to and downstream of the first linear portion, the forward step portion comprising a radially inner surface spaced a third distance from the longitudinal axis of the gas turbine engine, an upstream surface positioned upstream of the radially inner surface of the forward step portion, and a downstream surface positioned downstream of the radially inner surface of the forward step portion;

wherein the second distance is greater than the third distance;

wherein the third distance is greater than the first distance;

wherein the upstream surface and the downstream surface of the forward step portion are positioned axially between the upstream projection and the downstream projection;

wherein the forward step portion is positioned axially closer to the upstream projection than the downstream projection; and wherein the forward step portion extends axially over a majority of an axial distance between the upstream projection and the downstream projection.

2. The stage of claim 1, wherein the first linear portion is positioned adjacent to the fore end portion.

3. The stage of claim 1, wherein the forward step honeycomb seal further comprises a second linear portion positioned adjacent to and downstream of the forward step portion, the second linear portion comprising a radially inner surface spaced a fourth distance from the longitudinal axis of the gas turbine engine, and wherein the fourth distance is greater than the third distance.

4. The stage of claim 3, wherein the first linear portion has a first axial length, wherein the second linear portion has a second axial length, and wherein the first axial length is less than the second axial length.

5. The stage of claim 3, wherein the shroud further comprises an aft end portion positioned downstream of the forward step honeycomb seal.

6. The stage of claim 5, wherein the aft end portion is positioned adjacent to the second linear portion, wherein the aft end portion comprises a radially inner surface spaced a fifth distance from the longitudinal axis of the gas turbine engine, and wherein the fifth distance is equal to or greater than the fourth distance.

7. The stage of claim 1, wherein the upstream surface of the forward step portion extends substantially perpendicular to the longitudinal axis of the gas turbine engine.

8. The stage of claim 1, wherein the upstream surface of the forward step portion extends at a non-perpendicular angle with respect to the longitudinal axis of the gas turbine engine.

9. The stage of claim 1, wherein the radially inner surface of the fore end portion, the radially inner surface of the first linear portion, and the radially inner surface of the forward step portion extend substantially parallel to the longitudinal axis of the gas turbine engine.

10. The stage of claim 1, wherein the first linear portion and the forward step portion are integrally formed with one another.

11. The stage of claim 1, wherein a tip of the upstream projection is spaced a sixth distance from the longitudinal axis of the gas turbine engine, wherein a tip of the downstream projection is spaced a seventh distance from the longitudinal axis of the gas turbine engine, wherein the sixth distance is equal to the seventh distance, and wherein the sixth distance is greater than the third distance.

12. The stage of claim 1, wherein the forward step honeycomb seal extends to an aft end of the shroud.

13. The stage of claim 1, wherein the upstream projection and the downstream projection each extend radially away from the airfoil in a substantially straight manner.

14. A method of sealing an air gap in a stage of a gas turbine engine, comprising:

providing a bucket extending radially about a longitudinal axis of the gas turbine engine, the bucket comprising an airfoil and a tip portion extending from the airfoil, the tip portion comprising an upstream projection and a downstream projection extending away from the airfoil;

providing a shroud facing the bucket and having a cylindrical shape, the shroud comprising a fore end portion comprising a radially inner surface spaced a first distance from the longitudinal axis of the gas turbine engine; and positioning a forward step honeycomb seal on the shroud downstream of the fore end portion and facing the bucket, the forward step honeycomb seal comprising:

a first linear portion comprising a radially inner surface spaced a second distance from the longitudinal axis of the gas turbine engine; and a forward step portion positioned adjacent to and downstream of the first linear portion, the forward step portion comprising a radially inner surface spaced a third distance from the longitudinal axis of the gas turbine engine, an upstream surface positioned upstream of the radially inner surface of the forward step portion, and a downstream surface positioned downstream of the radially inner surface of the forward step portion;

wherein the second distance is greater than the third distance;

wherein the third distance is greater than the first distance;

wherein the upstream surface and the downstream surface of the forward step portion are positioned axially between the upstream projection and the downstream projection;

wherein the forward step portion is positioned axially closer to the upstream projection than the downstream projection; and wherein the forward step portion extends axially over a majority of an axial distance between the upstream projection and the downstream projection; and sealing an air gap between the shroud and the bucket with the forward step honeycomb seal.

15. A gas turbine engine, comprising:

a compressor;

a combustor in communication with the compressor; and a turbine in communication with the combustor, the turbine comprising:

a bucket extending radially about a longitudinal axis of the gas turbine engine, the bucket comprising an airfoil and a tip portion extending from the airfoil, the tip portion comprising an upstream projection and a downstream projection extending away from the airfoil;

a shroud facing the bucket and having a cylindrical shape, the shroud comprising a fore end portion comprising a radially inner surface spaced a first distance from the longitudinal axis of the gas turbine engine; and a forward step honeycomb seal positioned on the shroud downstream of the fore end portion and facing the bucket, the forward step honeycomb seal comprising:

a first linear portion comprising a radially inner surface spaced a second distance from the longitudinal axis of the gas turbine engine; and a forward step portion positioned adjacent to and downstream of the first linear portion, the forward step portion comprising a radially inner surface spaced a third distance from the longitudinal axis of the gas turbine engine, an upstream surface positioned upstream of the radially inner surface of the forward step portion, and a downstream surface positioned downstream of the radially inner surface of the forward step portion;

wherein the second distance is greater than the third distance;

wherein the third distance is greater than the first distance;

wherein the upstream surface and the downstream surface of the forward step portion are positioned axially between the upstream projection and the downstream projection;

wherein the forward step portion is positioned axially closer to the upstream projection than the downstream projection; and wherein the forward step portion extends axially over a majority of an axial distance between the upstream projection and the downstream projection.

16. The gas turbine engine of claim 15, wherein the forward step honeycomb seal further comprises a second linear portion positioned adjacent to and downstream of the forward step portion, the second linear portion comprising a radially inner surface spaced a fourth distance from the longitudinal axis of the gas turbine engine, and wherein the fourth distance is greater than the third distance.

17. The gas turbine engine of claim 16, wherein the shroud further comprises an aft end portion positioned downstream of the forward step honeycomb seal and adjacent the second linear portion, wherein the aft end portion comprises a radially inner surface spaced a fifth distance from the longitudinal axis of the gas turbine engine, and wherein the fifth distance is equal to or greater than the fourth distance.

18. The gas turbine engine of claim 15, wherein the upstream projection and the downstream projection each extend radially away from the airfoil in a substantially straight manner, wherein a tip of the upstream projection is spaced a sixth distance from the longitudinal axis of the gas turbine engine, wherein a tip of the downstream projection is spaced a seventh distance from the longitudinal axis of the gas turbine engine, wherein the sixth distance is equal to the seventh distance, and wherein the sixth distance is greater than the third distance.

19. The gas turbine engine of claim 15, wherein the forward step honeycomb seal extends to an aft end of the shroud.

* * * * *